US008929769B2

(12) United States Patent
Shanun et al.

(10) Patent No.: US 8,929,769 B2
(45) **Date of Patent: *Jan. 6, 2015**

(54) LASER PRINTER CARTRIDGE WITH INCREASED TONER STORAGE CAPACITY

(71) Applicant: Clover Technologies Group, LLC, Ottawa, IL (US)

(72) Inventors: Sagie Shanun, Valley Village, CA (US); Joda Paulus, Chatsworth, CA (US); Bruce Scott, Granada Hills, CA (US)

(73) Assignee: Clover Technologies Group, LLC, Ottawa, IL (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/924,596

(22) Filed: Jun. 23, 2013

(65) Prior Publication Data

US 2013/0279935 A1 Oct. 24, 2013

Related U.S. Application Data

(63) Continuation of application No. 12/788,474, filed on May 27, 2010, now Pat. No. 8,494,407.

(51) Int. Cl.
*G03G 15/00* (2006.01)
*G03G 15/08* (2006.01)

(52) U.S. Cl.
CPC ..... *G03G 15/0894* (2013.01)
USPC ..... 399/109

(58) Field of Classification Search
USPC ..... 399/109, 107, 111, 113, 119
See application file for complete search history.

(56) References Cited

U.S. PATENT DOCUMENTS 8,494,407 B2 * 7/2013 Shanun et al. ..... 399/109

* cited by examiner

*Primary Examiner* — Billy Lactaoen

(57) ABSTRACT

Remanufactured laser printer toner cartridges and methods of manufacture by which predetermined structures internal to the toner hopper section are removed preferably by a robotic laser cutter, a volume increasing cap is provided for the modified toner hopper section and the cartridge is re-assembled to yield a remanufactured toner cartridge that has a capacity to store toner that is significantly increased in comparison to the storage capacity of the OEM toner cartridge.

8 Claims, 11 Drawing Sheets

LASER PRINTER CARTRIDGE WITH INCREASED TONER STORAGE CAPACITY

RELATED APPLICATIONS

This application is a continuation of U.S. patent application Ser. No. 12/788,474 titled "Laser Printer Cartridge With Increased Toner Storage Capacity" filed May 27, 2010, now issued U.S. Pat. No. 8,494,407, which is incorporated herein by reference in its entirety.

FIELD OF INVENTION

The invention relates generally to laser printer cartridges, and more particularly to modifying laser printer cartridges to increase the capacity of the cartridge to store toner within the toner cartridge.

BACKGROUND

Laser printer technology including the associated toner cartridges is a fast growing, highly competitive industry that strives for continuous improvements related to the performance of cartridges and printers. Some examples of print characteristics that manufacturers are continuously trying to improve include print quality, print resolution, print speed, cost and versatility of equipment, such as to enable printing, copying and photographing. Additionally original equipment manufacturers (OEMs) continuously innovate in regard to the manner in which toner is stored in toner cartridges. In recent times some OEMs have developed toner cartridges that are included with the laser printer as sold originally, with such cartridges generally referred to as "starter" cartridges. Typically such starter cartridges include a volume of toner that is less than the volume of toner provided in replacement cartridges.

With a new model printer and cartridge, the OEM may design the starter cartridge to have a physically smaller toner reservoir than a standard cartridge, such that the empty starter cartridges have limited value to cartridge refillers, and competition from refilled cartridges is consequently reduced or delayed.

One approach to increasing the capacity of a toner cartridge is to provide new plastic toner hopper shells to replace the OEM toner hopper shells. The imaging components normally associated with the toner hopper are then moved from the original toner hopper shells to the new shells. A significant drawback of this approach is that the replacement shells may not perfectly replicate the physical dimensions and other characteristics of the OEM shells, and the printing components may thus be slightly misaligned or not interact properly with other mechanisms in the printer.

Also, as is well known, toner cartridges are typically manufactured with automated or semi-automated processes. Such processes typically include use of manufacturing techniques that require specific structural features on or in the cartridge that in turn facilitate the manufacturing process but do not play any role in the operation of the end use of the cartridge in a laser printer. For example, original equipment manufactured toner cartridges typically have structures that facilitate the picking up and moving or placing a cartridge shell, housing or member from one location to another location during the manufacturing process. This process is known as "pick and place" and these structures exist solely or primarily to enable manufacturing equipment, such as robots to pick and place the cartridge housing or member from one location to another location.

SUMMARY

In accordance with the description set forth below laser printer toner cartridges and methods of making laser printer toner cartridges having a relatively greater capacity to store toner within the volume of an OEM toner cartridge are provided. A spent OEM toner cartridge is modified by removing internal structures that are not needed for end use of the cartridge and that are not needed to retain structural support sufficient to enable the modified cartridge to properly function in a printing operation. The modified cartridge may thus accommodate a toner volume equal to or greater than that of a standard OEM cartridge, providing a lower cost per page to the customer.

The preferred method of removal is by a laser, preferably a pre-programmed robotic laser. Other methods, such as use of a 3 or 4 axis Computer Numerical Control (CNC) router, may also be used. The method may be adapted to remove such internal structures from a variety of conventional OEM cartridges, each with different structural designs. The method includes predetermining a series of line segments corresponding to the structures to be removed, and then pre-setting the robotic laser to travel and project a laser beam along a beam path for each line segment, and with the speed of travel of the laser, the angle of incidence of the laser to the line segment and the beam intensity pre-determined according to the material of construction of the cartridge and the thickness of the material along each line segment. By this process the modified, remanufactured cartridge has an increased internal volume available to hold or store an increased amount of toner in comparison to the toner storage capacity of the original OEM cartridge.

In addition, a cap is provided to cover the opening in the OEM toner hopper section, with the cap having extended walls that create a greater volume or capacity of the OEM cartridge to hold toner. In some embodiments, the cap may be sealed to toner hopper section, such as with a bead of an adhesive material, to help prevent leakage of toner from the modified hopper.

These and other embodiments, features, aspects, and advantages of the invention will become better understood with regard to the following description, appended claims and accompanying drawings.

BRIEF DESCRIPTION OF THE DRAWINGS

The foregoing aspects and the attendant advantages of the present invention will become more readily appreciated by reference to the following detailed description, when taken in conjunction with the accompanying drawings, wherein.

Reference symbols or names are used in the Figures to indicate certain components, aspects or features shown therein. Reference symbols common to more than one Figure indicate like components, aspects or features shown therein, although the components, aspects or features are not necessarily identical.

DETAILED DESCRIPTION

Figure 1:
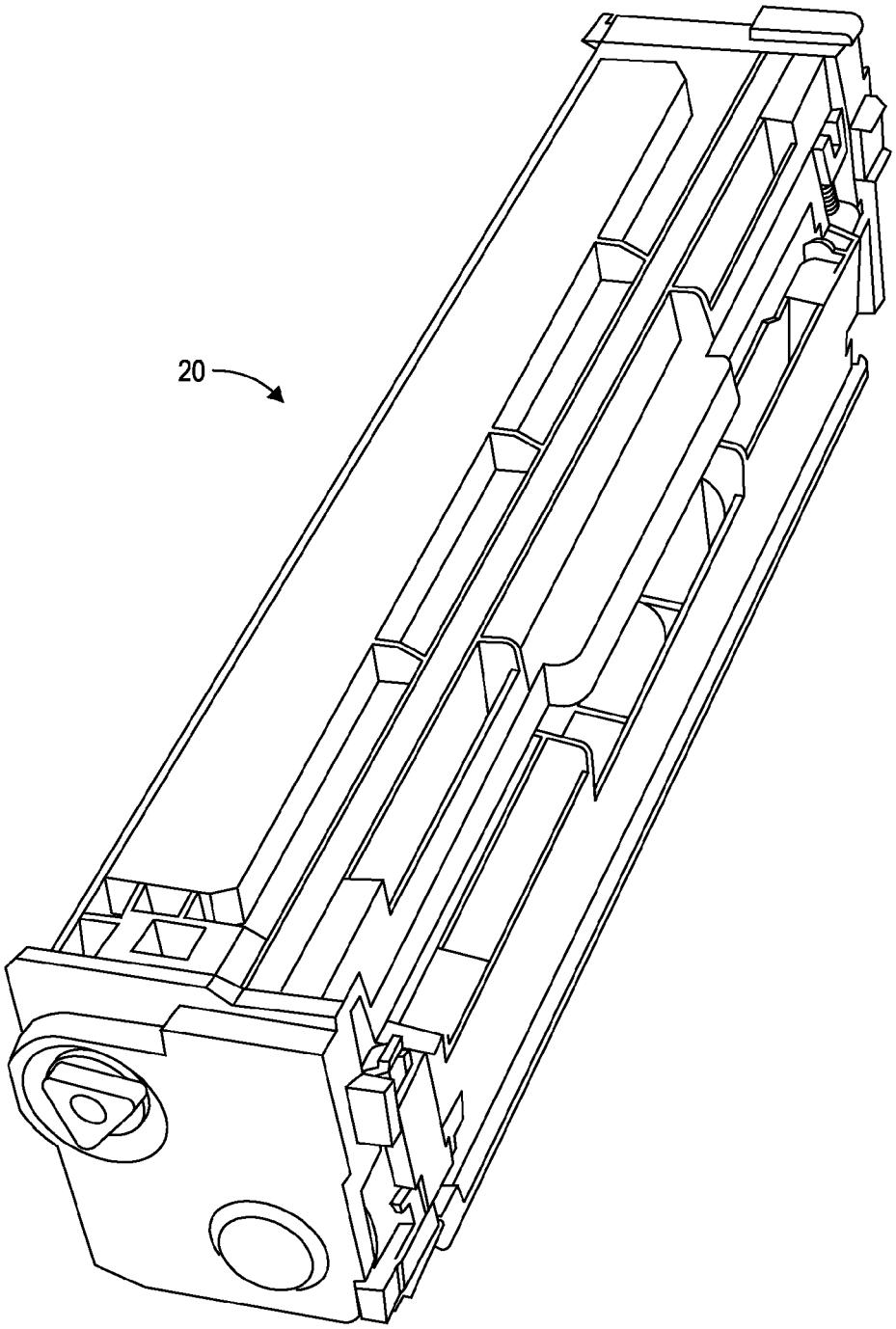
FIG. 1 PRIOR ART
FIG. 1 is a perspective view of a conventional OEM laser printer toner cartridge.
Figure 2:
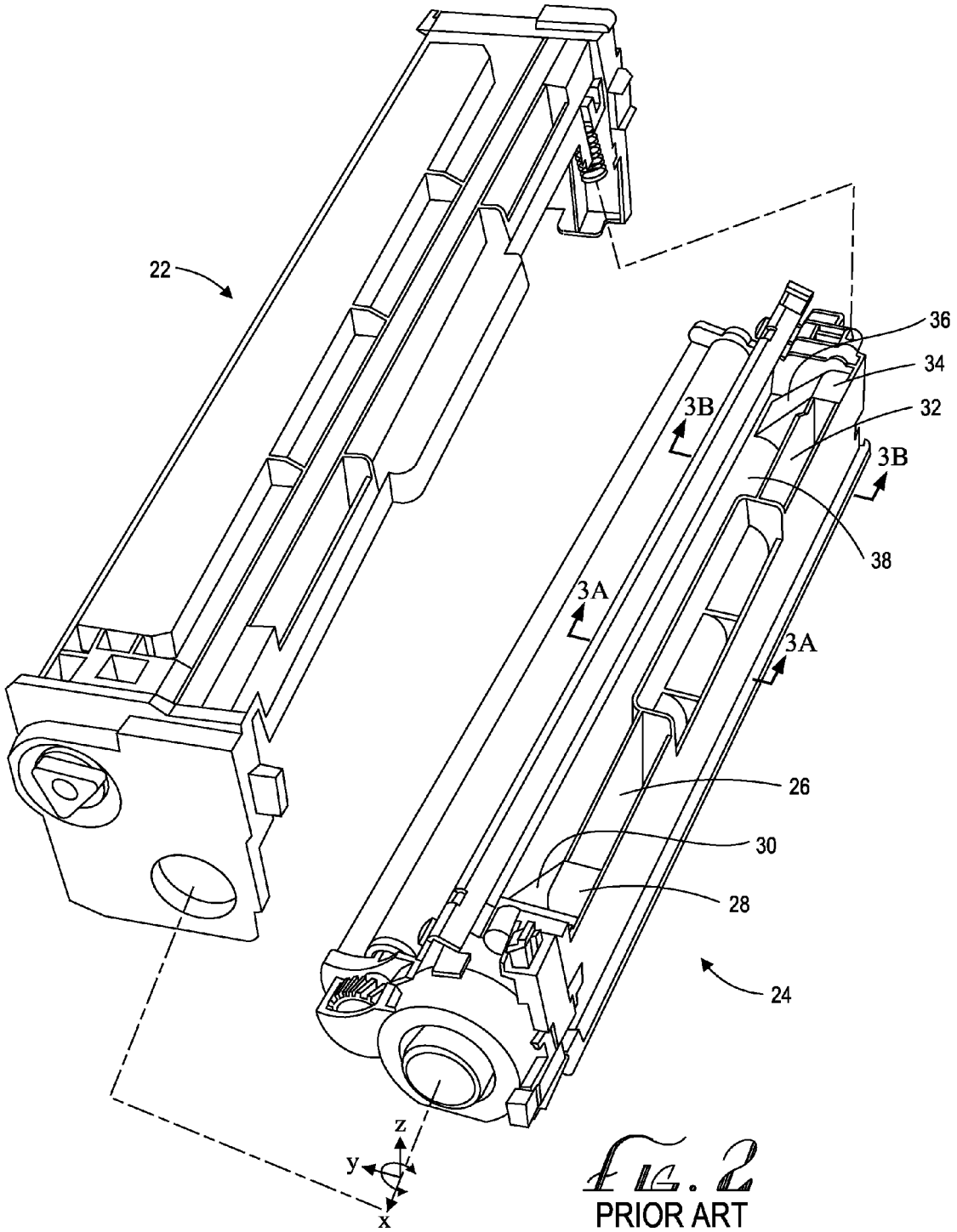
FIG. 2 PRIOR ART
FIG. 2 is an exploded perspective view of the FIG. 1 cartridge showing separately the toner supply hopper and the toner waste hopper.

In accordance with embodiments of the present invention remanufactured laser printer toner cartridges and methods of manufacture having increased capacity for storage of toner are described. With reference to FIGS. 1 and 2 a typical, conventional OEM laser printer toner cartridge 20 is shown. The exemplary toner cartridge 20 includes a waste hopper section 22 and a toner hopper section 24. The OEM toner hopper section 24 includes OEM toner, not shown, several structures used in the manufacture of the OEM cartridge but not needed during printing operation and other components not pertinent to the structure or operation of the remanufactured cartridges further described herein.

As shown in FIG. 2 the toner hopper section 24 includes a first outward facing wall section 28 and a first, top slanted wall section 30 preferably formed integral with each other and with the toner hopper section 24 itself. With reference to the x-y-z coordinates shown in FIG. 4, a first platform or shelf member 26 extends toward the center of the hopper section 24 along the x-axis. At the opposite end of, and internal to the toner hopper section 24 a second outward facing wall section 34 and second, top slanted wall section 36 are preferably formed integral with each other and with the toner hopper section 24 itself. Also, a second platform or shelf member 32 extends toward the center of the hopper section 24 along the x-axis. A back or rear wall 38 extends along a significant length of the interior of the toner cartridge section 24.

Figure 3A:
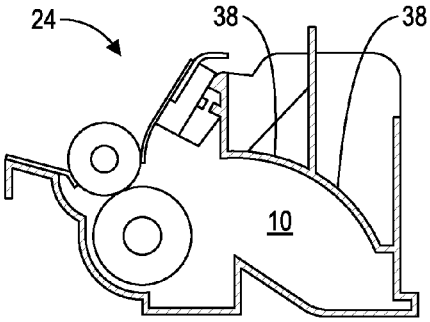
FIGS. 3A and 3B are cross-sections of the conventional OEM laser printer toner cartridge along lines 3A-3A and 3B-3B, respectively, of FIG. 2.
Figure 3B:
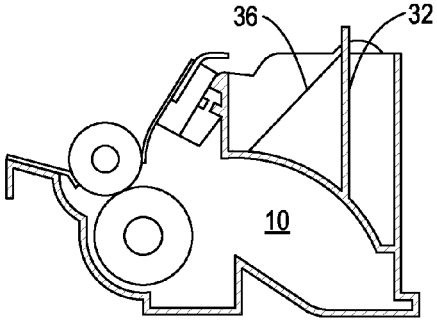

FIGS. 3A and 3B are cross sectional views along lines 3A-3A and 3B-3B of FIG. 2, respectively, further illustrating some of the structures of the exemplary toner hopper section. Specifically, back or rear wall 38 can be seen to form the top panel of a chamber 10 in which the cartridge's toner supply is stored. Top slanted wall section 36 and platform shelf 32 can also be seen.

Many of the above-identified wall sections and platform or shelf members are internal to the toner hopper section, and are believed to have some function or serve some purpose in the manufacturing of the OEM cartridge. For example, it is believed that these structures may have had use in conventional, robotic "pick and place" tasks wherein the cartridge hopper, at various stages of manufacture is picked up from one location by automatic equipment and then placed in another location for subsequent manufacturing steps. While these structures may have been useful for manufacturing of the OEM cartridge, they may not necessary for the end use of the cartridge, that is, for printing. Furthermore, these structures limit the space within the cartridge toner hopper section, which space is then not available to store or keep toner. As a result the OEM cartridge has capacity for less toner than it would if these structures were not present.

While the above-described wall and platform structures have been described with respect to a typical, single OEM cartridge, other OEM cartridges have different structural designs, component shapes and features. The present invention is not limited to any single OEM cartridge or to any single interior cartridge design or specific walls, platforms or members, but rather is directed to any and all structures that occupy space internal to a toner cartridge hopper section and are not needed for the end use of the toner cartridge, that is, not needed to enable printing by the laser printer.

Figure 4:
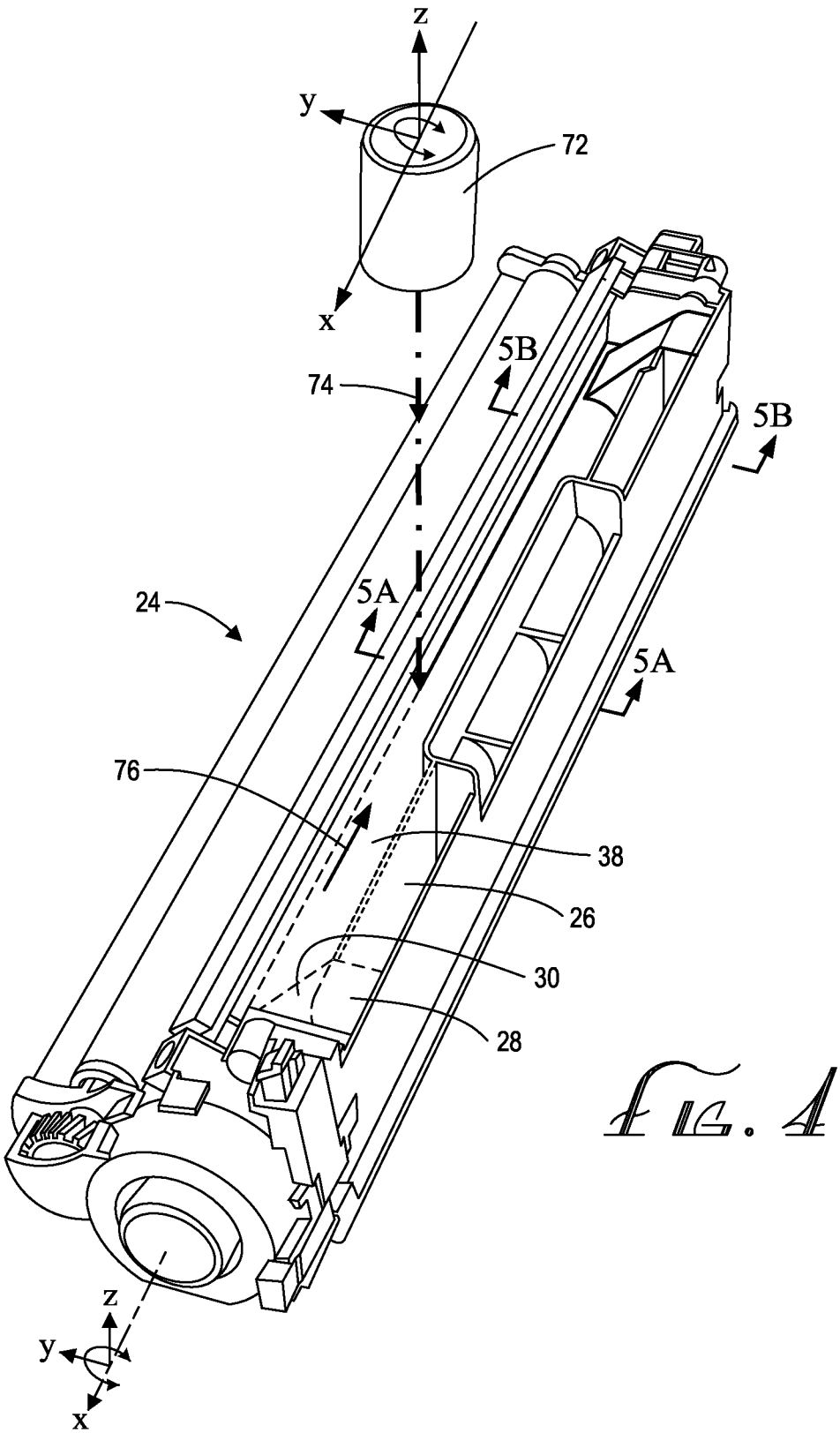
FIG. 4 is an exploded perspective view of the FIG. 2 toner supply hopper partially disassembled and showing internal structures used to facilitate the OEM manufacturing process.
Figure 6:
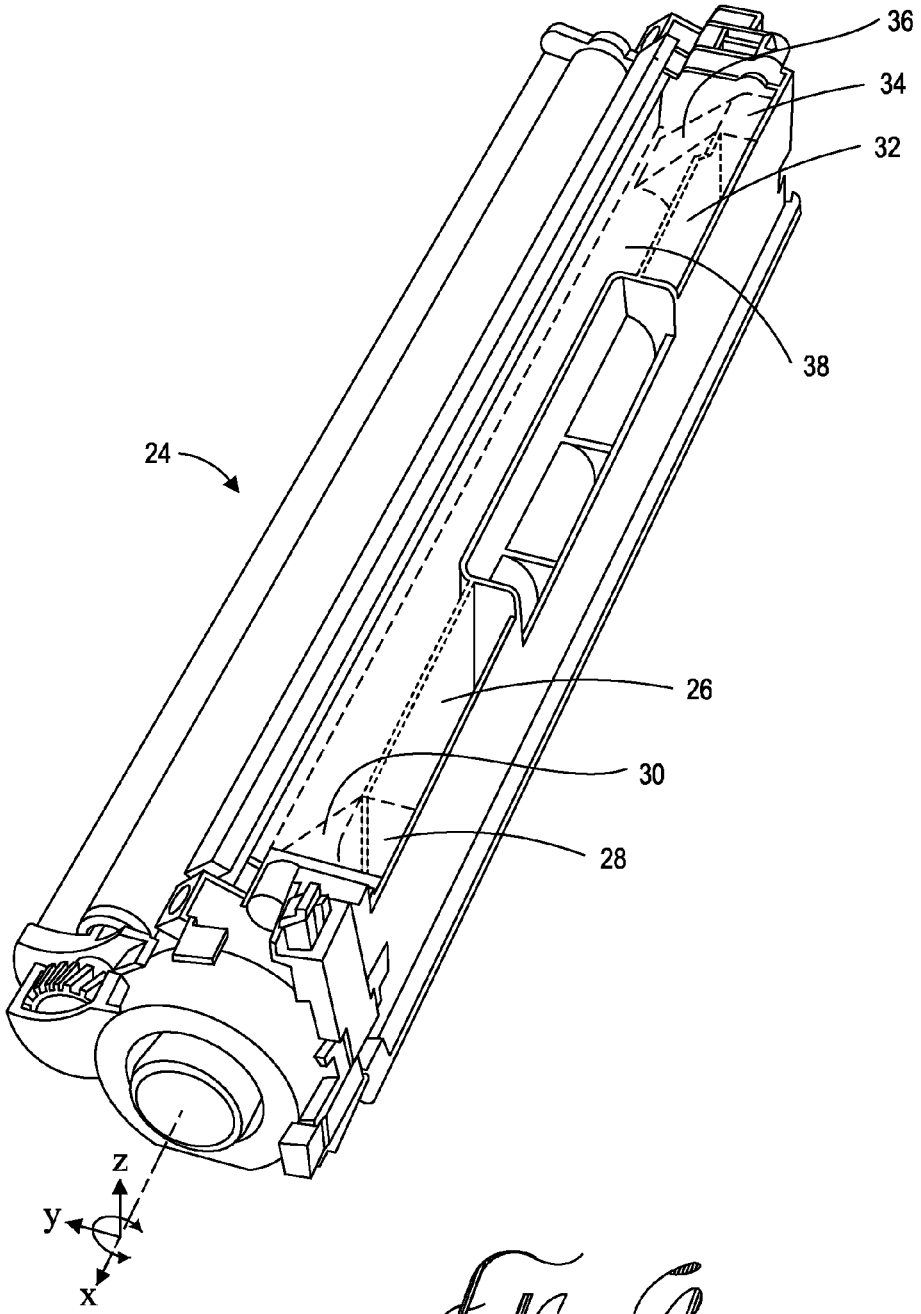
FIG. 6 is a perspective view of a first embodiment of an OEM toner hopper section modified to increase its capacity to retain toner and to include a cap.

With reference to FIGS. 4 and 6 a remanufactured toner hopper section is shown with the internal walls, platforms and members 26, 28, 30, 32, 34, 36 and 38 shown in dashed lines to indicate that they have been removed from the cartridge toner hopper section 24. An exemplary method of removing these internal structures or members is by a laser, schematically shown as laser cutter 72 in FIG. 4.

Computer controlled laser cutting and/or etching devices such as described herein above and suitable for use in the present invention are readily available from manufacturers such as Xenetech Global, Inc., 12139 Airline Highway, Baton Rouge, La. 70817 as its model XLT-1325 laser engraving system, or from BEAM Dynamics Inc., 541 Taylor Way, San Carlos, Calif. 94070. Computer programs or software applications as described herein above and suitable for use in the present invention to control the laser and the movement of the laser beam are readily available from Xenetech Global, Inc. as its Xenetech Graphic Workstation (XGW-32) software, as well as the Laser-Link software available from BEAM Dynamics Inc. The precise settings for the laser, that is, the path of travel, speed of travel, angle of the cutting beam relative to the cartridge hopper and the laser beam intensity, will vary according to the structural design and materials of construction for each type or brand of OEM toner hopper section that is to be remanufactured.

Laser 72 in FIG. 4 is preferably housed in a cabinet [not shown], both to provide for safety of operating personnel and for protection of the apparatus. The apparatus includes a movably adjustable optical system [not shown], typically driven by electric motors [not shown]. The movably adjustable optical system controls the location, focus, and speed of movement of the laser beam such that accurate cuts of the toner hopper are made. The laser 72 and movably adjustable optical system are operationally connected to a conventional computer [not shown] containing a central processor unit (CPU). The computer commands the operation of the laser 72 and the movement of the movably adjustable light in response to a selected computer program or software application that is run in the computer.

The movably adjustable optical system [not shown] may be commanded by the computer [not shown] to direct the laser beam 72 to a point on the toner hopper section 24 and to move in a direction along a predetermined path from one point to another at a selected constant or variable speed. The output power of the laser 72 is selected on the basis of the nature and thickness of the material intended to be cut, and may range from a laser beam output power of about 1 watt to about 100 watts.

The cutting and removing of these internal structures is accomplished such that the structural integrity of the toner hopper section 24 is not reduced or compromised to the extent that it will not function properly in a laser printer. In other words, removal of internal structures is accomplished such that the remanufactured toner cartridge retains structural integrity sufficient to function successfully in a printer. With these structures removed the remanufactured OEM cartridge toner section then has an enlarged internal volume or capacity with which to hold, store or contain more toner than did the original OEM cartridge.

In some embodiments, features which may be problematic to cut with a laser due their orientation, such as, for example, platform or shelf members 26 and 32 in FIGS. 4 and 6, may be left in place if they do not ultimately interfere with the function of the enlarged toner chamber.

Figure 5A:
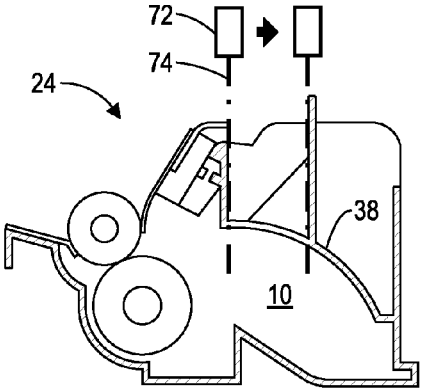
FIGS. 5A and 5B are cross-sections of the conventional FIG. 2 toner supply hopper partially disassembled along lines 5A-5A and 5B-5B, respectively, of FIG. 2.
Figure 5B:
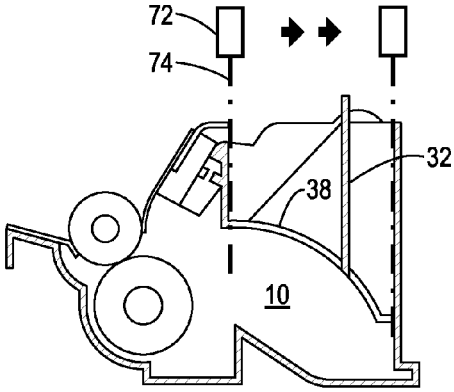

FIGS. 5A and 5B are cross sections along lines 5A-5A and 5B-5B of FIG. 4, respectively. FIG. 5A illustrates the laser 72 and cutting beam 74 in two positions at the beginning and end of a cut of back or rear wall 38; FIG. 5B shows a similar cut along line 5B-5B of FIG. 4, and illustrates how a structure that may be difficult to cut with the laser, platform shelf 32, may be left in place in embodiments of the invention.

It may be observed that the internal structures to be removed generally form portions of the wall of the chamber for storing toner; the portions of the wall, or "panels", typically are supported by adjacent structures meeting the panels at large angles or nearly right angles. The panels are typically removed by cutting along the perimeters of the panels, such as with a laser cutting system. A newly-enlarged chamber for storing toner can then be formed by adding a cover or cap to the toner hopper assembly.

Figure 7:
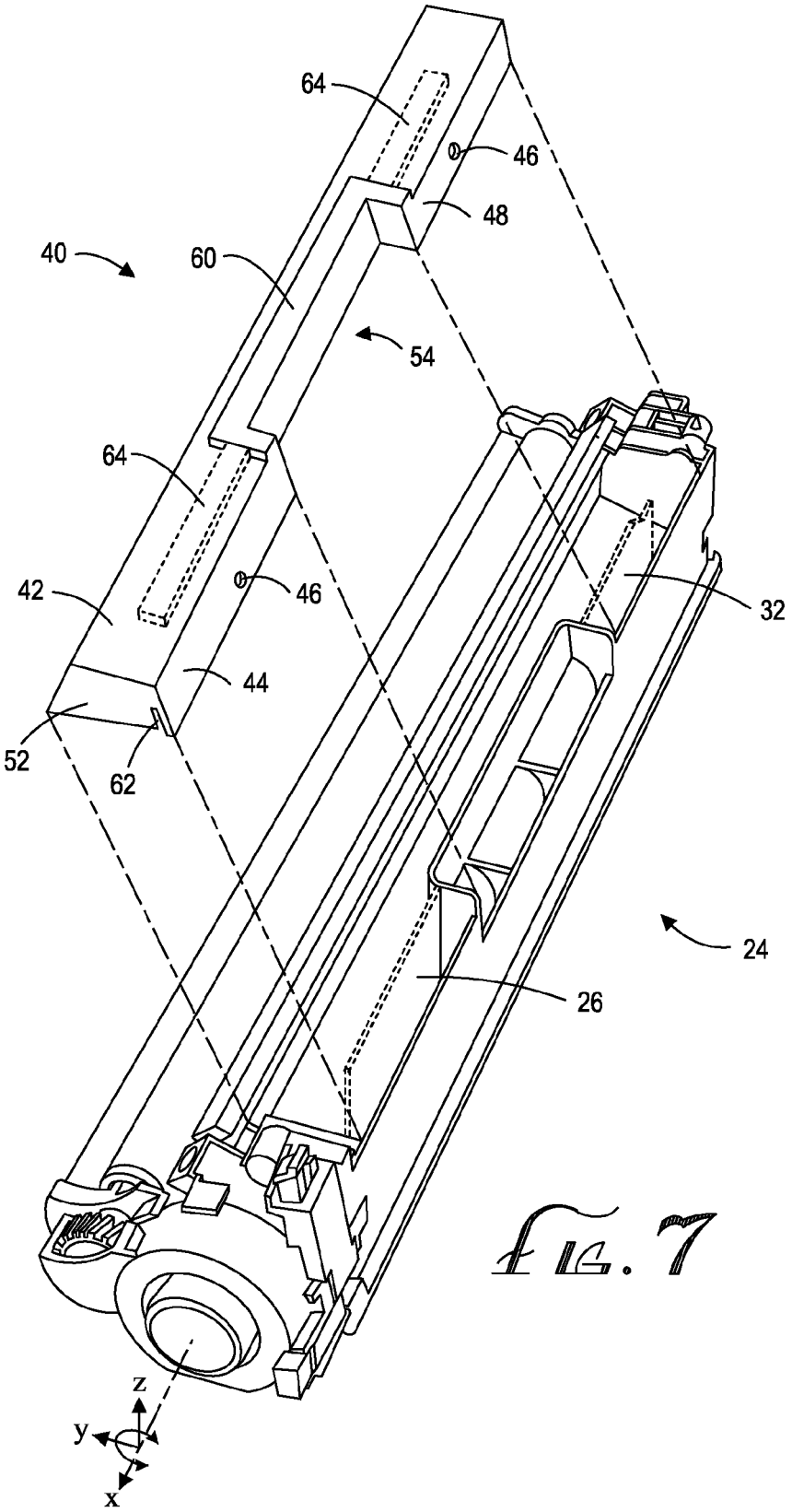
FIG. 7 is a perspective view of a waste hopper section, the FIG. 4 toner hopper section and toner hopper cap in a partially assembled condition.
Figure 8:
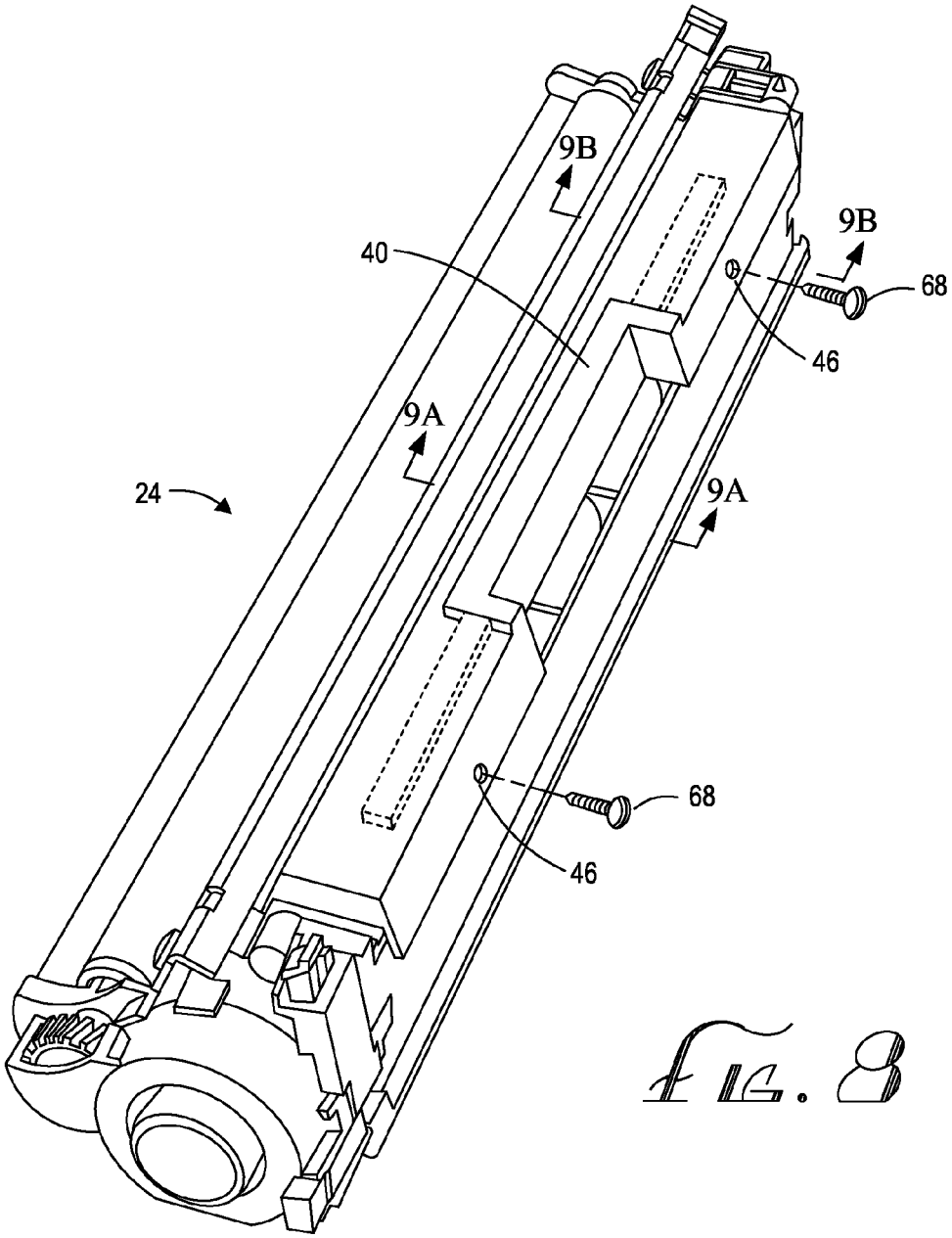
FIG. 8 is a perspective view of the FIG. 4 toner hopper section showing the cap in place and location of attachment fasteners.

With reference to FIGS. 7, 8 and 9 an exemplary embodiment of a modified OEM cartridge including an added cap portion will be described. Shown in FIG. 7 is an OEM toner hopper section 24 that has been modified by removing certain internal structural members used in manufacture of the cartridge but not needed for its end use of enabling printing. Also shown in FIG. 7 is a cover or end cap 40 that is configured to be attachable to the toner hopper section and to further increase the volume or capacity to hold or store toner. For the exemplary cartridge design shown in FIGS. 1-3, the cap 40 includes a front face or wall 42, a first lower wall extension 44, a second lower wall extension 48, fastener holes 46, side extension walls 52, a U-shaped front recess 54, and a front extending U-shaped border 60 to define the cap structure. In some embodiments, the cap may also include raised portions 64 to accommodate internal toner hopper sections that were left in place, such as platform shelves 26 and 32. Cap 40 also includes a slot 62 at one end and a corresponding slot at it opposite end, not shown, the slots adapted to tightly fit over extensions on the hopper section 24 and to facilitate a tight fit of the cap over the hopper opening.

Figure 10:
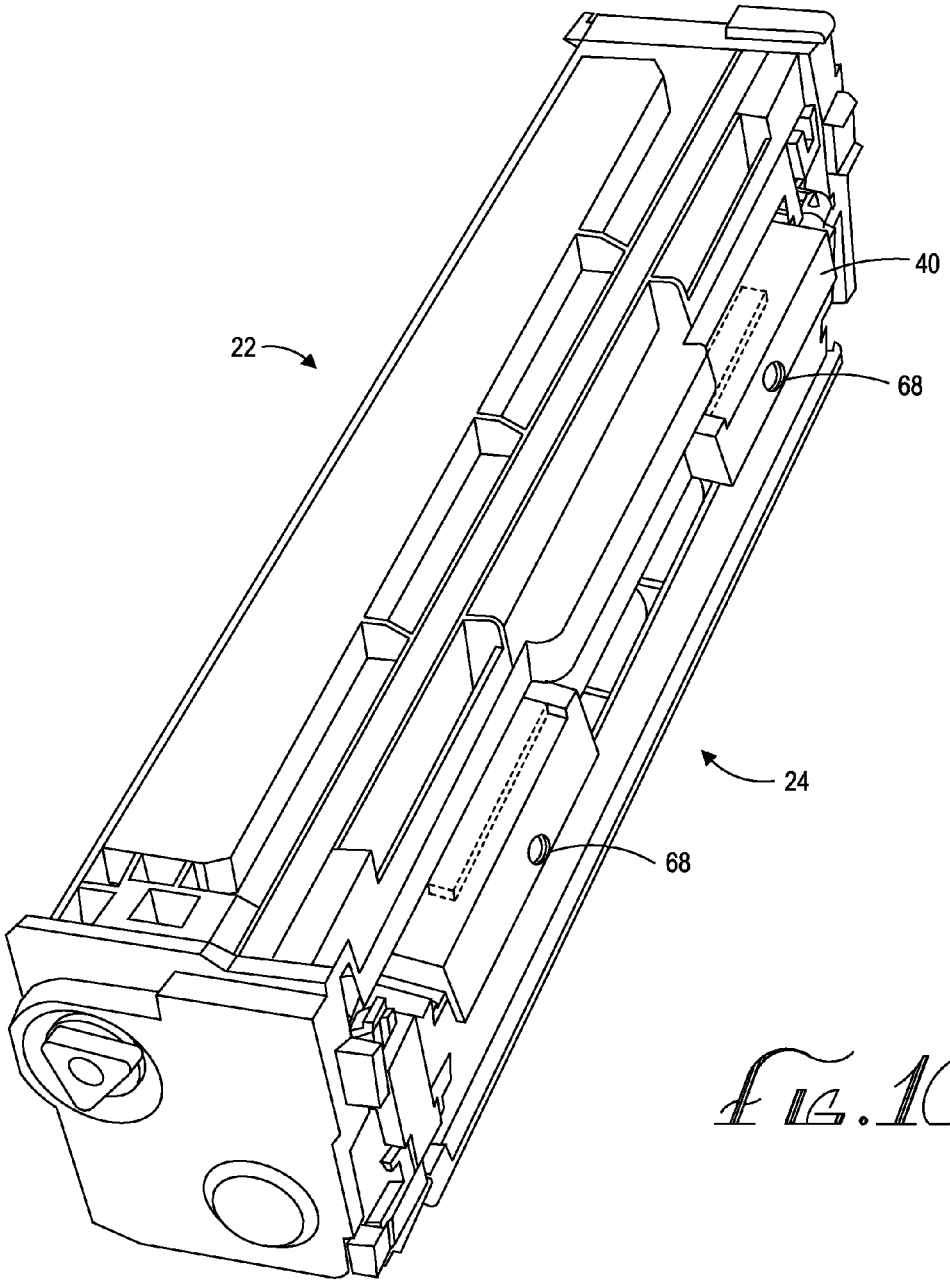
FIG. 10 is a perspective view of the a reassembled toner cartridge having increased toner storage capacity, according to an embodiment of the invention.

FIG. 8 illustrates the installation of the cap onto the toner hopper assembly. The cap 40 may be attached to the toner hopper assembly 24 by any common fastening method, such as screws 68, which are inserted into holes 46. With reference to FIG. 10, the cap 40 is shown in place over the toner hopper section 24, with the toner hopper section and the toner waste hopper sections joined together. Shown in FIG. 10 are the assembled, remanufactured toner hopper 24 and waste hopper 22 with the cap 40 fastened to the toner hopper section 24 by conventional screws 68.

Figure 9A:
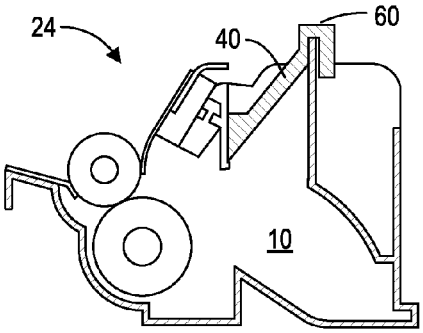
FIGS. 9A and 9B are cross-sections of the toner hopper section of FIG. 8 showing the cap in place along lines 9A-9A and 9B-9B, respectively, of FIG. 8.
Figure 9B:
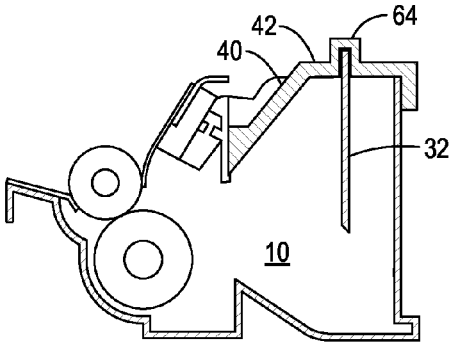

FIGS. 9A and 9B are cross sections along lines 9A-9A and 9B-9B of FIG. 8, respectively, showing cover or end cap 40 in place. It may be observed that the volume of toner chamber 10 is greatly enlarged in comparison to the toner chamber of the unmodified cartridge, as illustrated in FIGS. 3A and 3B.

With reference to FIG. 7, an illustrative removal of toner hopper section internal structures by a robotic laser is further described. Preferably a spent OEM toner hopper section is placed in a jig or some other fixture where its precise location with respect to a predetermined laser beam path is set. Then the robotic laser is activated and it proceeds along a series of predetermined path segments, with predetermined beam intensity and predetermined speed of travel over each path segment to remove predetermined structures within in the toner hopper section. As shown in FIG. 4 the laser moves along a path shown by arrow 76. As also shown the dashed lines indicate where the laser beam 74 has cut predetermined structures 26, 28, 30 and 38 from the hopper section, and solid lines in the path of laser beam travel indicate those structures that are in the path of travel and are to be cut. In other embodiments, the required modification to the cartridge may be relatively minor, such as, for example, the cutting of a simple opening in the toner hopper, and may be accomplished by other methods, such by a Computer Numeric Control (CNC) router, or a simple router with a guide fixture.

In some embodiments of the invention, a sealant may be utilized to prevent leakage from the modified toner cartridge, and to bond the cover to the modified toner hopper. The sealant may, for example, be a one part modified silane polymer, such as produced under the brand names LOCTITE 5510™ and LOCTITE 5512™. Other sealants may be utilized, such as, for example, hot melt adhesives. The sealant may be applied manually, or with automated equipment.

FIG. 10 illustrates exemplary equipment that may be used to automate the deposition of a sealant material, such as a one part modified silane polymer, in embodiments of the invention. A programmable benchtop dispensing robot 510, such as produced by I&J Fisnar Company of Wayne, N.J., may be "trained" to dispense an adhesive material in a precise three-dimensional (x, y, z) path. A support structure and cross member 512 support a movable head 514 that positions a disposing nozzle 516 in the X and Z axes, while a sliding work table 518 positions the target for the disposing nozzle in the Y axis. A front panel 520 provides user controls, such as controls to select and initiate a programmed dispensing sequence and perform maintenance, such as "purging" the supply lines of fluid material. A connector panel 522 includes connectors to accept signals from an external programming unit (not shown) for initially programming the robot. Other controls and connectors may be located on the rear of the unit (not shown).

Figure 11:
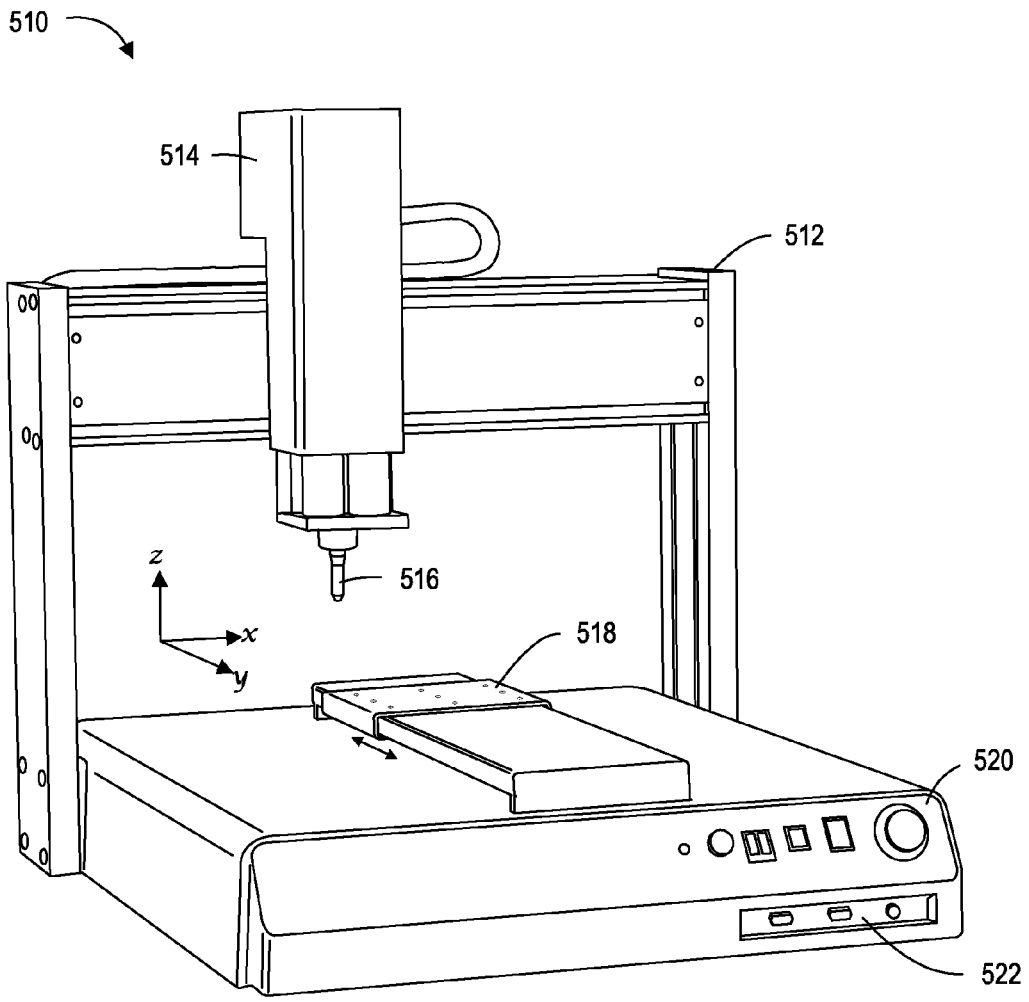
FIG. 11 is a perspective view of an exemplary sealant dispensing device that may be utilized in embodiments of the invention.

FIG. 11 is a perspective view of an embodiment in which a sealant material, such as an adhesive, is applied between the toner hopper 24 and the cap or cover 40 to reduce the possibility of toner leakage from the modified cartridge. As seen in FIG. 11, the nozzle 516 of the programmable benchtop dispensing robot may deposit a bead of adhesive 602 along the perimeter of the opening in the toner hopper; in other embodiments, the adhesive may instead be applied to the cover, or to both the toner hopper and cover.

Figure 12:
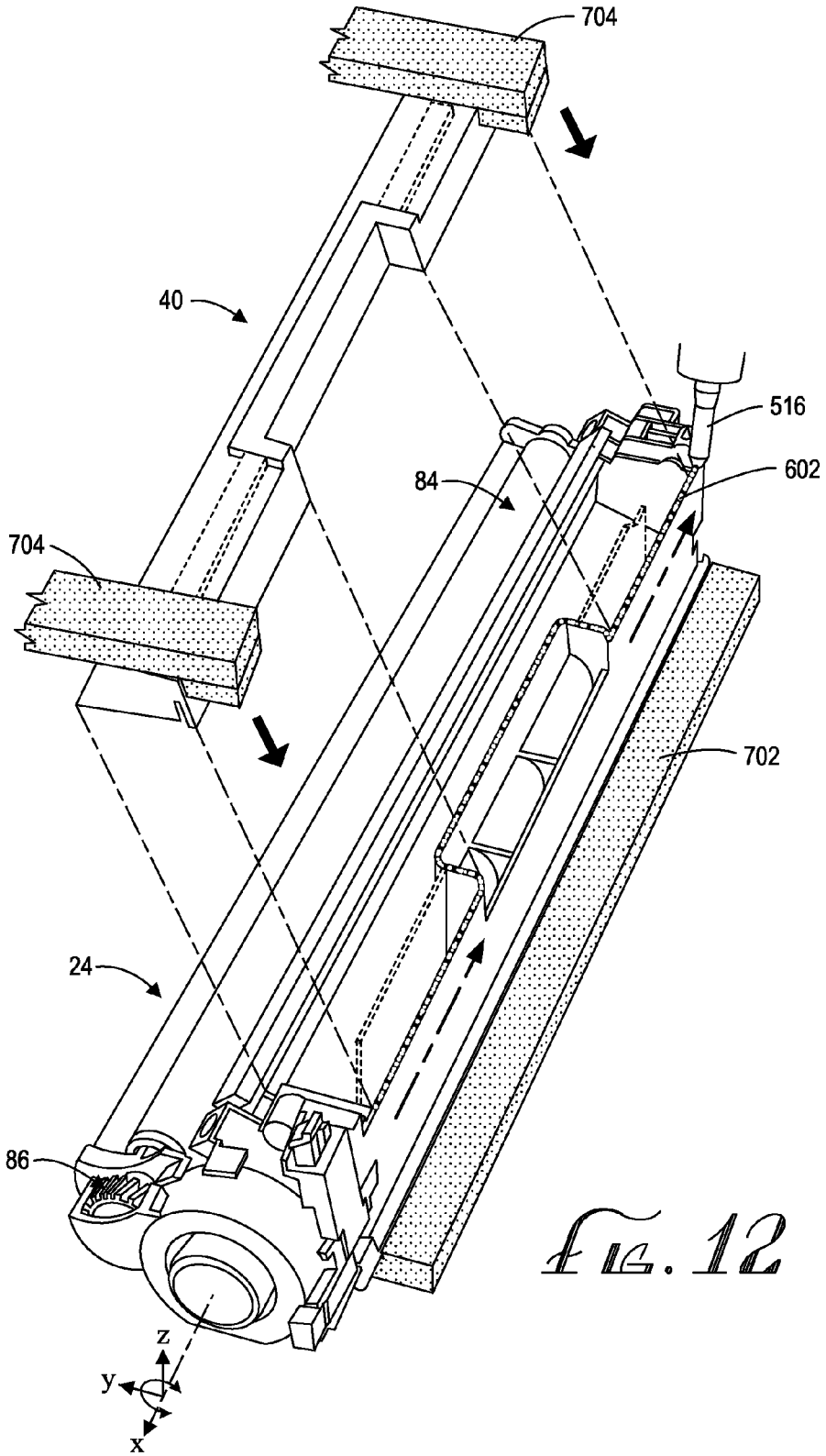
FIG. 12 is a perspective view of a further embodiment of the invention, in which a sealant is used to attach the cover to the modified toner hopper, and an alignment fixture is utilized to ensure proper alignment.

As also shown in FIG. 12 are portions of an alignment fixture that may be used in embodiments of the invention. Only the portions of the alignment fixture that engage the toner hopper 24 and cover 40 are illustrated; the remainder of the fixture comprises a structure to rigidly hold the components, while allowing the components to be brought together and held in proper alignment; the design and construction of such fixtures are well known in the art. Shown in FIG. 12 are the fixture's toner hopper holding portion 702 and cap or cover holding portion 704. The cap or cover holding portion 704 is adapted to move the cap or cover 40 into proper alignment with the toner hopper after the bead of sealant has been applied.

An advantage of embodiments of the invention over alternative remanufacturing methods is the preservation of those portions of the OEM toner hopper assembly that hold important printing components, such as the developing roller 84 and associated gear 86 shown in FIG. 12. In an alternative remanufacturing method, to increase the capacity of the toner hopper the entire plastic structure of the toner hopper assembly is replaced with an aftermarket plastic structure. In doing so, the precise alignment of the printing components may be compromised; the aftermarket plastic structure may also be more flimsy than the OEM structure, potentially allowing the printing components to drift out of alignment during use.

In some embodiments of the invention, the toner capacity of a starter cartridge may be increased beyond that of a "standard" OEM cartridge, providing the customer with additional increased value. For example, the cap may be designed so as to take advantage of any free space available adjacent to the cartridge when installed in the printer.

Figure 13:
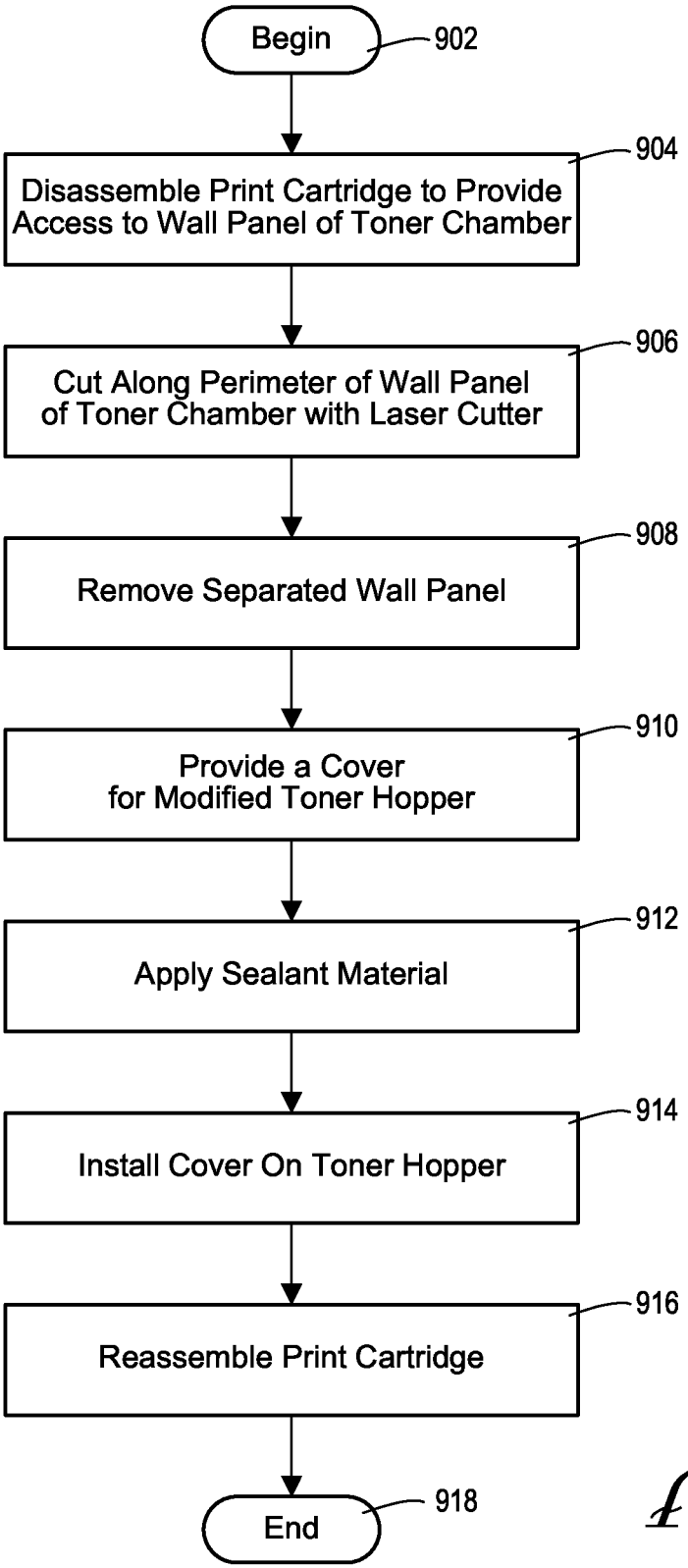
FIG. 13 is a flowchart illustrating an exemplary method of the invention.

FIG. 13 is a flow diagram illustrating a exemplary method of the invention. The method begins 902 with the disassembly the print cartridge 904 to provide access to at least one wall panel of the cartridge's toner chamber. Disassembly may, for example, involve separating the waste hopper section of the cartridge from the toner hopper section. In an exemplary cartridge, disassembly allows access to multiple panels forming a wall of the toner chamber; the panels are separated by structures not essential to the operation of the cartridge, but which were used during the initial manufacture of the cartridge.

The exemplary method continues with the cutting 906 of at least one of the panels forming the wall of the toner chamber, such as with a laser cutter. The laser typically is robotically programmed to follow the perimeter of the panel, thus separating the panel form the surrounding structures. Once separated by the laser cutter, the panel is removed 908 from the toner cartridge. In some embodiments, multiple panels might be removed; the surrounding structures, if not necessary to the strength and function of the cartridge, may also be removed, depending on how accessible the structures are for cutting with the laser cutter.

In other embodiments, the cutting may be achieved by other methods, such as with a CNC router or by manual cutters. Some toner cartridges may require only a simple modification, such as the cutting away of a rectangular area on the toner hopper.

Once a portion of the wall of the toner chamber has been opened by the cutting and removal of one or panels, a replacement cover is provided 910 and is installed on the toner hopper. The cover is designed to provide a new toner chamber wall, with the modified toner chamber having a greater volume than the original toner chamber. The cover may be installed on the toner hopper by mechanical fasteners such as screws, by adhesives, or by any common attachment method. Embodiments of the invention can thus be seen as enlarging the original toner chamber of a cartridge by removing a portion of the wall of the chamber, and providing a cap or cover which creates a new toner chamber encompassing the original chamber, plus additional volume created by removal of the portion of wall.

In some embodiments, a sealant may be applied 912 to help prevent leakage of toner from the reassembled cartridge. The sealant may be applied by a robotic gluing robot, as described above, or by other methods, such as manual application. In addition to sealing the cartridge, the sealant material may also function as an adhesive, attaching the cap to the toner hopper.

In some embodiments, installing the cover 914 may include the use of an alignment fixture to precisely align the cover with the toner hopper, and to hold it in place while the sealant sets or forms a bond. In other embodiments, the cover may simply be installed with screws or fasteners.

With the cover in place, the print cartridge may be reassembled 916, which may include other remanufacturing steps, such as the replacement or refurbishment of various printing components, and the refilling of the cartridge with toner. Once reassembled, the method ends 918.

Although specific embodiments of the invention have been described, various modifications, alterations, alternative constructions, and equivalents are also encompassed within the scope of the invention.

The specification and drawings are, accordingly, to be regarded in an illustrative rather than a restrictive sense. It will, however, be evident that additions, subtractions, deletions, and other modifications and changes may be made thereunto without departing from the broader spirit and scope of the invention as set forth in the claims.

What is claimed is:

1. A method comprising:

providing a toner hopper section comprising at least one panel forming a wall of a toner chamber, wherein the toner chamber has a first volume;

removing the at least one panel; and coupling a replacement wall with the toner hopper section, wherein the toner chamber after coupling the replacement has a second volume; and wherein the second volume is greater than the first volume.

2. The method of claim 1, wherein the removing is performed by a laser cutter.

3. The method of claim 2, wherein the laser cutter is robotically controlled.

4. The method of claim 1, wherein the removing is performed by a Computer Numeric Control (CNC) router.

5. A process comprising:

providing a toner hopper section, wherein the toner hopper section has a first volume;

removing a portion of the toner hopper section; and, coupling a cap with the toner hopper section to allow the toner hopper section to have a second volume.

6. The process of claim 5, wherein said removing is by laser cutting.

7. The process of claim 5, wherein said removing is by a CNC router.

8. A remanufactured toner hopper section, the toner hopper section prior to remanufacture comprising an original toner chamber defined in part by at least one wall panel, the remanufactured toner hopper section comprising:

at least one opening formed by removal of at least a portion of the at least one wall panel; and, a cap coupled with the toner hopper section, the cap serving to form an enlarged toner chamber encompassing the original toner chamber and at least one added volume.

* * * * *

UNITED STATES PATENT AND TRADEMARK OFFICE

CERTIFICATE OF CORRECTION

PATENT NO. : 8,929,769 B2
APPLICATION NO. : 13/924596
DATED : January 6, 2015
INVENTOR(S) : Sagie Shanun, Joda Paulus and Bruce Scott It is certified that error appears in the above-identified patent and that said Letters Patent is hereby corrected as shown below:

In the Specification

Column 2, line 37, "sealed to toner" should be changed to --sealed to the toner--.
Column 3, line 10, "the a reassembled toner" should be changed to --the reassembled toner--.
Column 4, line 7, "may not necessary" should be changed to --may not be necessary--; line 36, "Calif." should be changed to --CA--.
Column 5, line 54, "it" should be changed to --its--.
Column 6, line 14, "within in the" should be changed to --within the--; line 24, "such by" should be changed to --such as by--; line 61, "As also shown in FIG. 12 are portions" should be changed to --Also shown in FIG. 12 are portions--.
Column 7, line 25, "a exemplary" should be changed to --an exemplary--; lines 26-27, "disassembly the print cartridge" should be changed to --disassembly of the print cartridge--.

Signed and Sealed this
Fourteenth Day of April, 2015

Michelle K. Lee

Michelle K. Lee
*Director of the United States Patent and Trademark Office*